US006412920B1

(12) United States Patent
Matsumoto et al.

(10) Patent No.: US 6,412,920 B1
(45) **Date of Patent: *Jul. 2, 2002**

(54) INK JET PRINTING HEAD, INK JET HEAD CARTRIDGE AND PRINTING APPARATUS

(75) Inventors: Haruyuki Matsumoto; Hajime Yamamoto; Mineo Kaneko; Tsuguhiro Fukuda; Masashi Miyagawa, all of Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/741,039

(22) Filed: Oct. 30, 1996

Related U.S. Application Data

(63) Continuation of application No. 08/202,094, filed on Feb. 25, 1994, now abandoned.

(30) Foreign Application Priority Data

Feb. 26, 1993 (JP) ..... 5-038394

(51) Int. Cl.[7] ..... B41J 2/05; B41J 2/21
(52) U.S. Cl. ..... 347/58; 347/43; 347/64
(58) Field of Search ..... 347/62, 63, 64, 347/65, 56, 15, 43, 58, 57

(56) References Cited

U.S. PATENT DOCUMENTS

| | | | | | |
|---|---|---|---|---|---|
| 4,251,824 | A | * | 2/1981 | Hara | 347/15 X |
| 4,339,762 | A | * | 7/1982 | Shirato | 347/62 |
| 4,380,771 | A | * | 4/1983 | Takatori | 347/43 |
| 4,463,359 | A | * | 7/1984 | Ayata | 347/57 |
| 4,682,216 | A | * | 7/1987 | Sasaki | 347/43 X |
| 4,746,935 | A | | 5/1988 | Allen | 347/15 |
| 4,965,594 | A | * | 10/1990 | Komuro | 347/62 |
| 5,121,143 | A | | 6/1992 | Hayamizu | 347/15 |
| 5,481,287 | A | * | 1/1996 | Tachihara | 347/64 X |
| 5,550,568 | A | * | 8/1996 | Misomi | 347/12 |
| 5,559,543 | A | * | 9/1996 | Komuro | 347/62 |

FOREIGN PATENT DOCUMENTS

| | | | | |
|---|---|---|---|---|
| EP | 0372097 A1 | | 6/1990 | B41J/2/05 |
| EP | 385757 | * | 9/1990 | B41J/2/16 |
| EP | 0461935 A2 | | 12/1991 | B41J/2/05 |
| EP | 0526233 A2 | | 2/1993 | B41J/2/205 |
| JP | 401237145 | * | 9/1989 | B41J/3/04 |
| JP | 404067954 | * | 3/1992 | B41J/2/21 |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

An ink jet printing head for effecting printing by ejection of ink includes a first electrothermal transducer having a heat generating resistor with a first area and wiring electrically connected with the heat generating resistor; a second electrothermal transducer having a second heat generating resistor with an area which is different from the area of the first heat generating resistor; wherein bubbles are produced in ink materials upon application of electric signals to the electrothermal transducers, by which different volumes of ink materials are ejected; wherein the first and second electrothermal transducers have substantially the same bubble production threshold voltage.

16 Claims, 7 Drawing Sheets

INK JET PRINTING HEAD, INK JET HEAD CARTRIDGE AND PRINTING APPARATUS

This application is a continuation of Application No. 08/202,094, filed Feb. 25, 1994, now abandoned.

FIELD OF THE INVENTION AND RELATED ART

The present invention relates to an ink jet printing head for effecting recording by ejecting liquid droplets, more particularly to an ink jet printing head, an ink jet head cartridge and ink jet printing apparatus using electrothermal transducer elements as ejection energy generating elements.

The ink jet recording technique is advantageous in that the noise is low, that the recording speed is high, that the recording is possible on so-called plain paper, not a heat sensitive paper, and that color recording is possible by ejecting different color inks. However, in order to provide a sharp and clear color recording particularly on plain paper, the following problems remain.

It is difficult to suppress color mixture (so-called bleeding) at a boundary between different colors with sufficient recording density maintained, on the plain paper. In order for the characters or lines to be sharply and clearly formed on the plain paper, an ink comprising approx. 20% by weight of diethylene glycol, approx. 3% by weight of ethanol, approx. 3% by weight of dye, and the remaining part of water is used. If such an ink is used, the dots formed on the plain paper by the ejected liquid droplets are sharp at the edges and are of high density, if there are no color boundaries between adjacent different color portions.

However, such an ink normally exhibits low penetrating speed into the recording material and slow drying after deposition on the recording material, and therefore, if different color dots are formed adjacent to each other, the above-described bleeding occurs with the result of remarkably unclear recording. The tendency increases with increase of color printing speed. And therefore, it is highly desired that these problems are solved particularly in the case of high speed color recording.

The inventors have carried out repeated tests using yellow, magenta, cyan and black (Y, M, C, Bk) and plain paper, under the condition of 360 dpi (dots per inch). It has been found that the above-described problem can be solved by reducing the quantities of the inks other than black inks, as compared with the black ink.

Among ink jet recording systems, an ink jet printing system using thermal energy and a bubble created thereby in the ink, is suitable for high density nozzle arrangement. However, the change of the volume of the ejected liquid is small even if the energy is supplied to an electrothermal transducer element (heat generating resistor), and therefore, it is practically not possible to significantly change the volume of the ejected liquid by changing supplied energy. For this reason, in order to change the ejected volume of the ink in the ink jet printing system using thermal energy, the area of the heater or a cross-sectional area of the ejection outlet is changed to change the ejected volume of the ink.

The configuration of the heater has been determined so that the ratio of the length and the width of the heater is substantially constant, in consideration of the energy using-efficiency for ink ejection. For example, if it is assumed that the volumes of ejections of black, magenta, cyan and yellow inks are 80 pl, 50 pl and 40 pl, the black ink nozzle has an ejection area of 1000 $\mu m^2$, and a heater size of 30×150 $\mu m$; the magenta and cyan nozzles have an ejection area of 640 $\mu m^2$ and a heater size of 24×120 $\mu m$; and the yellow nozzle has an ejection outlet area of 500 $\mu m^2$ and a heater size of 21×105 $\mu m$. It has been found that these sizes are satisfactory.

However, if it is assumed that the electric pulse width of the voltage applied to the heater is preferably 3 $\mu$sec, the voltage applied to the black heater is 28 V, and the voltages applied to the magenta and cyan heaters are 22 V, and the voltage applied to the yellow heater is 20 V, and therefore, the applied conditions have to be changed, and therefore, a plurality of voltages and a plurality of the voltage application circuits have to be provided in the main assembly.

The reason for this is as follows. Even if an attempt is made to use the same electric signal applying condition, the nozzle for the black ink does not eject the ink with the application voltage condition for the nozzle of the yellow heater, and if the applied voltage condition for the black ink heater is used for the yellow, magenta or cyan ink heater, the heater is subjected to thermal overload with the result of remarkably small durability. If another attempt is made to apply 20 V to the respective heaters and to adjust the amount of the applied energy to the heater by the pulse width, the pulse width for the black ink heater has to be significantly increased to 6 $\mu$sec, for example. This is not preferable for the stability of the ink ejection or the like. As a result, a plurality of voltage application circuits for supplying different pulse widths are required. The use of a plurality of circuits increases costs.

SUMMARY OF THE INVENTION

Accordingly, it is a principal object of the present invention to provide a small size and low cost ink jet print head and ink jet cartridge which is easy to manufacture and wherein the volume of the ejected ink can be significantly changed even if the same electric signal is applied.

It is another object of the present invention to provide an ink jet printing head and an ink jet cartridge with which ink can be ejected in a proper manner by application of the same electric signal even if it comprises ink jet heaters having different configurations.

It is a further object of the present invention to provide an ink jet printing head, an ink jet cartridge and an ink jet printing apparatus, wherein the problems of the cost increase and complication due to the necessity for the plurality of voltage application circuits to eject different volumes of the ink, are solved.

According to an aspect of the present invention, there is provided an ink jet printing head for effecting printing by ejection of ink, comprising: a first electrothermal transducer having a heat generating resistor with a first area and wiring electrically connected with said heat generating resistor; a second electrothermal transducer having a second heat generating resistor with an area which is different from the area of said first heat generating resistor; wherein bubbles are produced in ink materials upon application of electric signals to said electrothermal transducers, by which different volumes of ink materials are ejected; wherein said first and second electrothermal transducers have substantially the same bubble production threshold voltage.

According to another aspect of the present invention, there is provided an ink jet printing head for effecting printing by ejection of ink, comprising: a first electrothermal transducer having a heat generating resistor with a first area and wiring electrically connected with said heat generating resistor; a second electrothermal transducer having a second heat generating resistor with an area which is different from the area of said first heat generating resistor; wherein bubbles are produced in ink materials upon application of electric signals to said electrothermal transducers, by which different volumes of ink materials are ejected; wherein lengths of said heat generating resistors measured in a direction of wiring, are substantially the same.

According to a further aspect of the present invention, there is provided an ink jet printing head for effecting printing by ejection of ink, comprising: a first electrothermal transducer having a heat generating resistor with a first area and wiring electrically connected with said heat generating resistor: a second electrothermal transducer having a second heat generating resistor with an area which is different from the area of said first heat generating resistor; wherein bubbles are produced in ink materials upon application of electric signals to said electrothermal transducers, by which different volumes of ink materials are ejected; wherein thicknesses of passivation films covering said first and second heat generating resistors are different.

According to a yet further aspect of the present invention, there is provided an ink jet head cartridge having the printing head and the ink container defined above, and an ink jet apparatus usable with the printing head defined above.

According to the present invention, the heaters have different areas so that the volumes of the ink ejected are made different depending on the colors, by which the bleeding can be decreased, while the manufacturing is easy. In addition, the size of the ink jet printing apparatus is small.

According to the present invention, the heaters having different dimensions have the same bubble-creating threshold electric pulse, so that only one kind of voltage application circuit is satisfactory, and therefore, the cost can be significantly reduced. In addition, the apparatus is simplified, and the size thereof is reduced.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
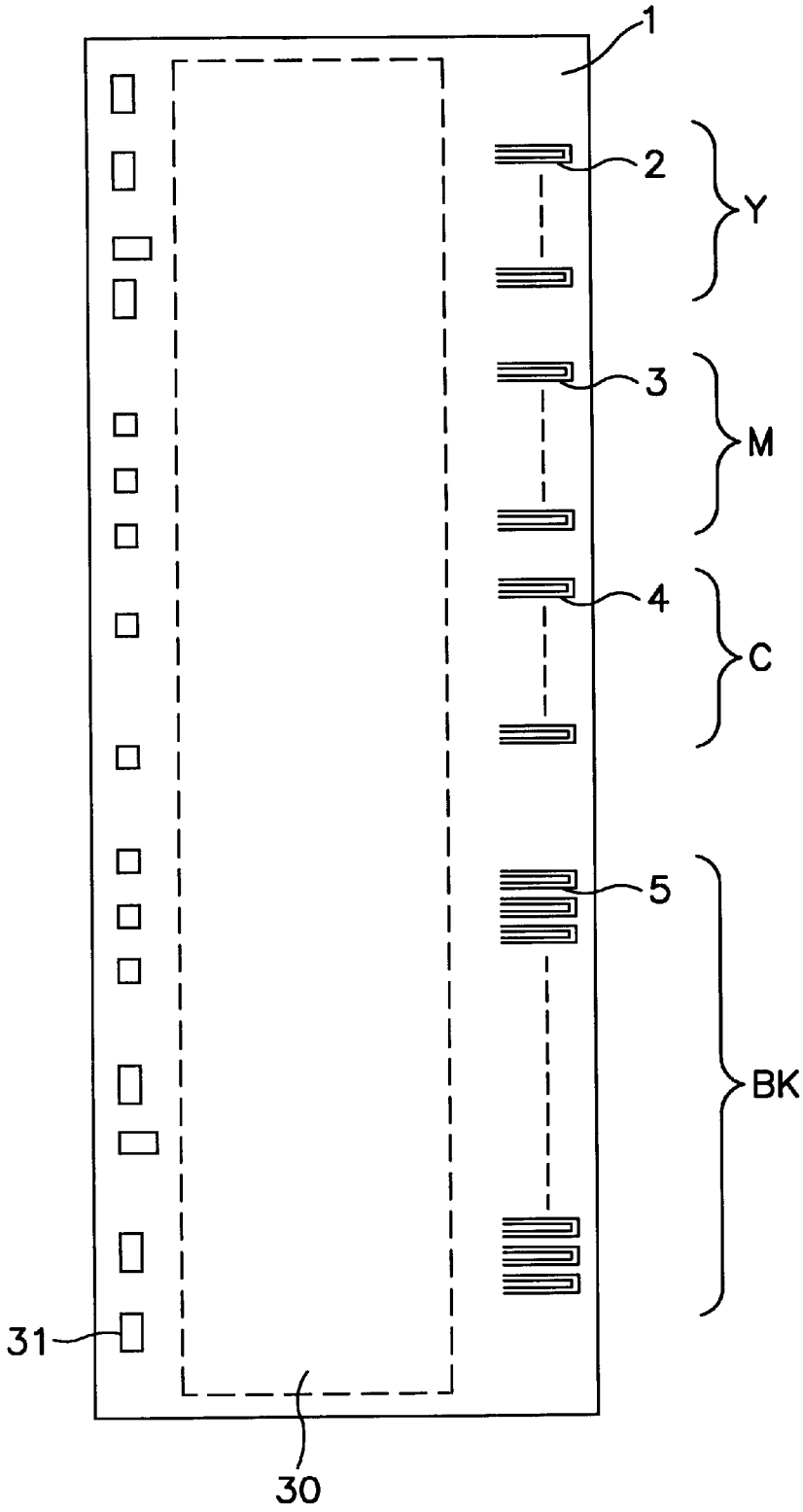
FIG. 1 is a schematic top plan view of a heater substrate, according to an embodiment of the present invention.
Figure 2:
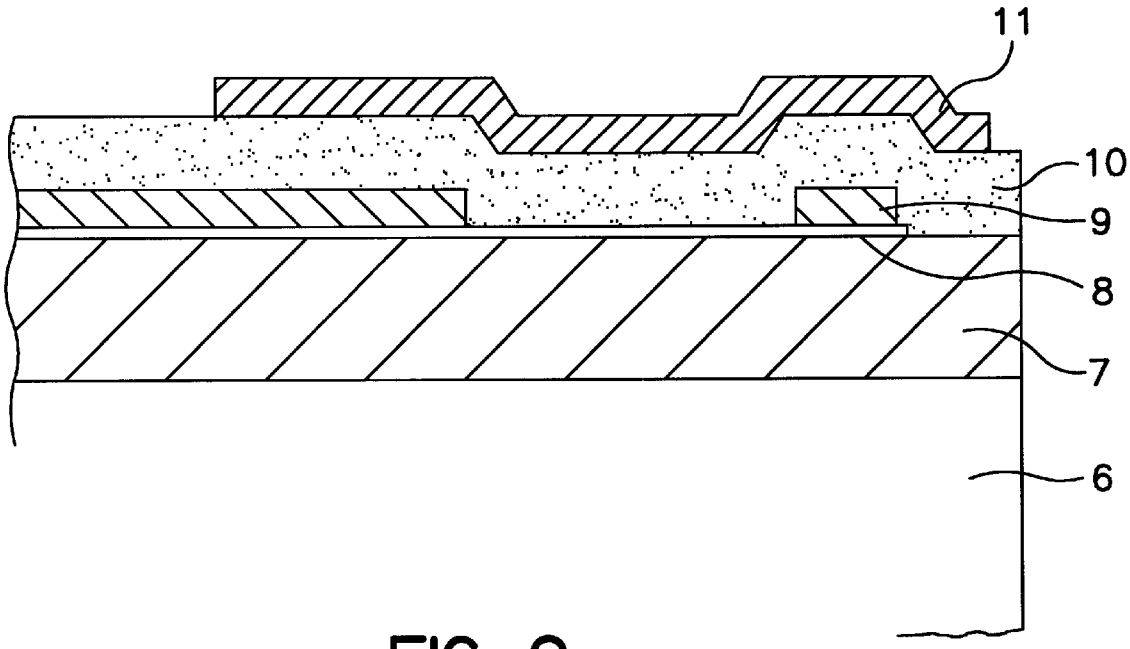
FIG. 2 is an enlarged schematic view of the heaters on the heater substrate or board, according to an embodiment of the present invention.

FIG. 1 is a schematic top plan view of a heater board 1 having electrothermal transducers in an ink jet head using thermal energy, according to an embodiment of the present invention. FIG. 2 is a partial enlarged view of the heater portion. The heater board 1 has a width of 13.3 mm, a length of 4.7 mm. It comprises a silicon wafer, having a thickness of approx. 0.6 mm and a $SiO_2$ layer having a thickness of approx. 2 $\mu$m, which constitute substrate. It further comprises a resistance layer of $HfB_2$ having a thickness of approx. 0.1 $\mu$m and an A1 layer (wiring layer) of approx. 0.5 $\mu$m, which are formed by sputtering. They are patterned through a proper photolithographic process.

It comprises 60 black ink heaters at the density of 360 dpi (approx. 70.6 $\mu$m interval), and 20 yellow, magenta, cyan ink heaters at the same density. In FIG. 1, only the outer configuration of the heater board and a part of the heaters and a part of wiring, for simplicity. Designated by reference numerals 2, 3, 4 and 5 are the heater for yellow ink, the heater for magenta ink, the heater for cyan ink and the heater for black ink. The area designated by a reference numeral 30 is an area in which function elements for driving the heaters are disposed. Designated by a reference numeral 31 are contact pads for receiving electric signals from a printing apparatus. The function elements, the heaters and the contact pads are electrically connected by proper wiring. The heater wiring is coated with a $SiO_2$ layer having a thickness of approx. 1 $\mu$m as a passivation layer, and a Ta layer having a thickness of approx. 0.5 $\mu$m which are formed through a sputtering process. They are patterned at proper positions through a photolithographic process. The heater board is manufactured through the above-described process.

Figures 3A, 3B, 3C:
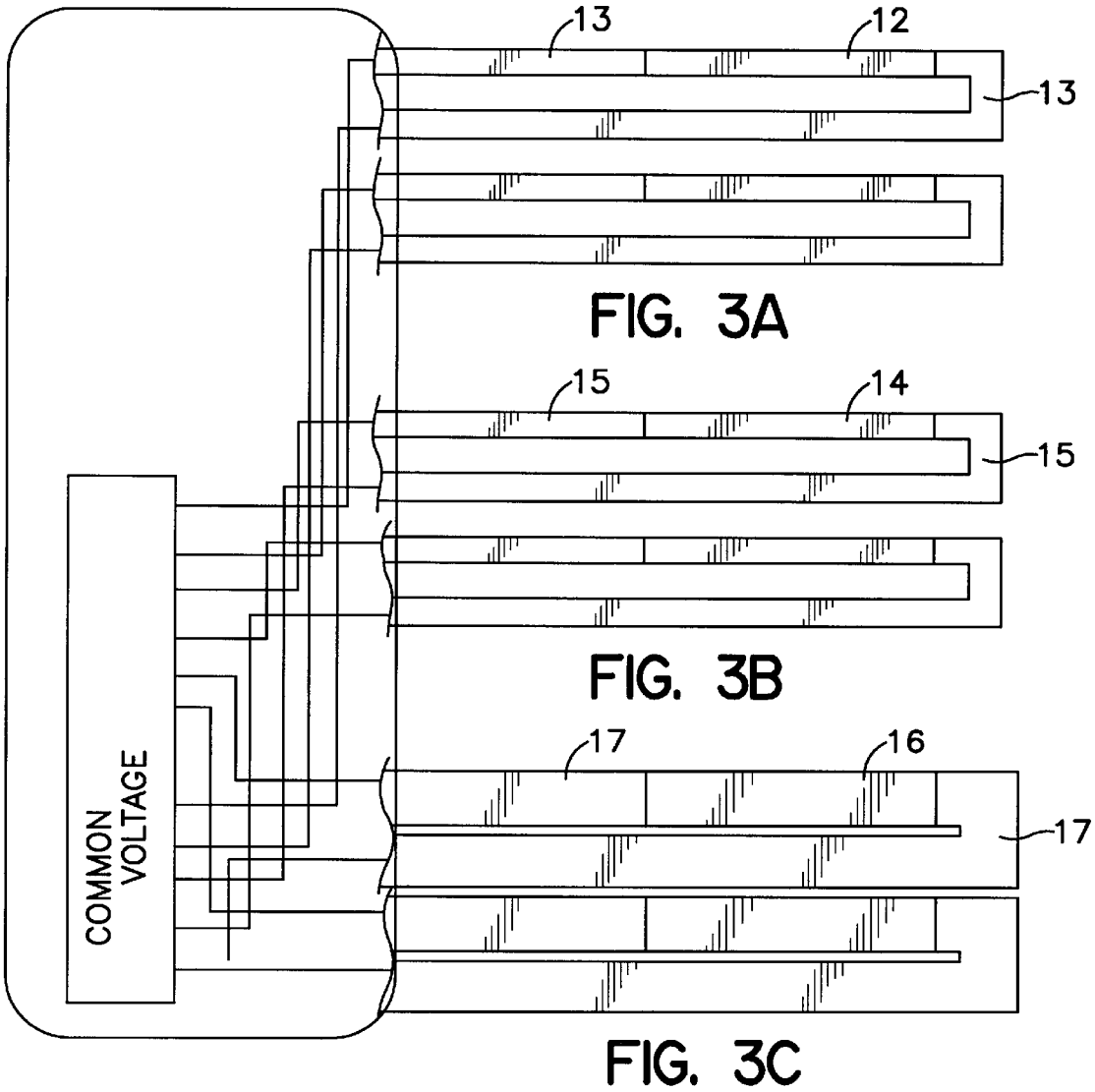
FIGS. 3A, 3B, and 3C are enlarged top plan views of yellow, magenta (cyan) and black ink heaters.

FIGS. 3A, 3B and 3C are enlarged schematic top plan views of the electrothermal transducers FIG. 3A illustrates an electrothermal transducer having an yellow ink heater 12 and wiring 13 connected therewith. FIG. 3B illustrates electrothermal transducers having magenta ink and cyan ink heaters 14 and wiring 15 connected therewith. FIG. 3C illustrates an electrothermal transducer having a black ink heater 16 and wiring 17 connected therewith.

In this embodiment, the black ink heater has a dimension of 30 $\mu$m in width and 150 $\mu$m in length, and the A1 wiring has 10 Ω in resistance. The dimensions of the magenta and cyan ink heaters is 19 $\mu$m in width and 150 $\mu$m in length, and the wiring resistance (A1) is 17 Ω. The dimension of the yellow ink heater is 15 $\mu$m in width and 150 $\mu$m in length, and the A1 wiring resistance thereof is 20 Ω.

In this embodiment, the heater areas are made different in order to make different the volume of the ejected ink. More particularly, the length of the heater (measured in the direction of the wiring) is commonly 150 $\mu$m, and the heater area is changed by changing the width thereof. By doing so, the required minimum voltage for creating a bubble in the ink upon the heater being driven (bubble creation threshold voltage) can be made common.

In order to supply the electric current to the heater in accordance with the heater area, the wiring resistance is decreased with increase of the heater area. In this embodiment, the resistance is reduced by increasing the wiring width for a larger area heater. However, if it is possible to adjust the resistance by changing the thickness or the like of the wiring, the adjustment using this is possible.

A nozzle wall or the like is formed on the heater board 1 thus produced, using photosensitive resin film or the like through a proper process, and the ink jet printing heat is manufactured using a glass plate laminating process or the like.

With the printing head thus produced, the bubble creating threshold voltages for the black, magenta, cyan and yellow ink heaters, are all approx. 24.3 V, when the applied pulse width is 3 μsec. Therefore, the common voltage can be used. Actually, however, the voltage to be applied is preferably 28 V, which is approx. 1.15 times the driving voltage. In any event, different ink ejection volume can be obtained with only one voltage being used.

Another Embodiment

Figure 4:
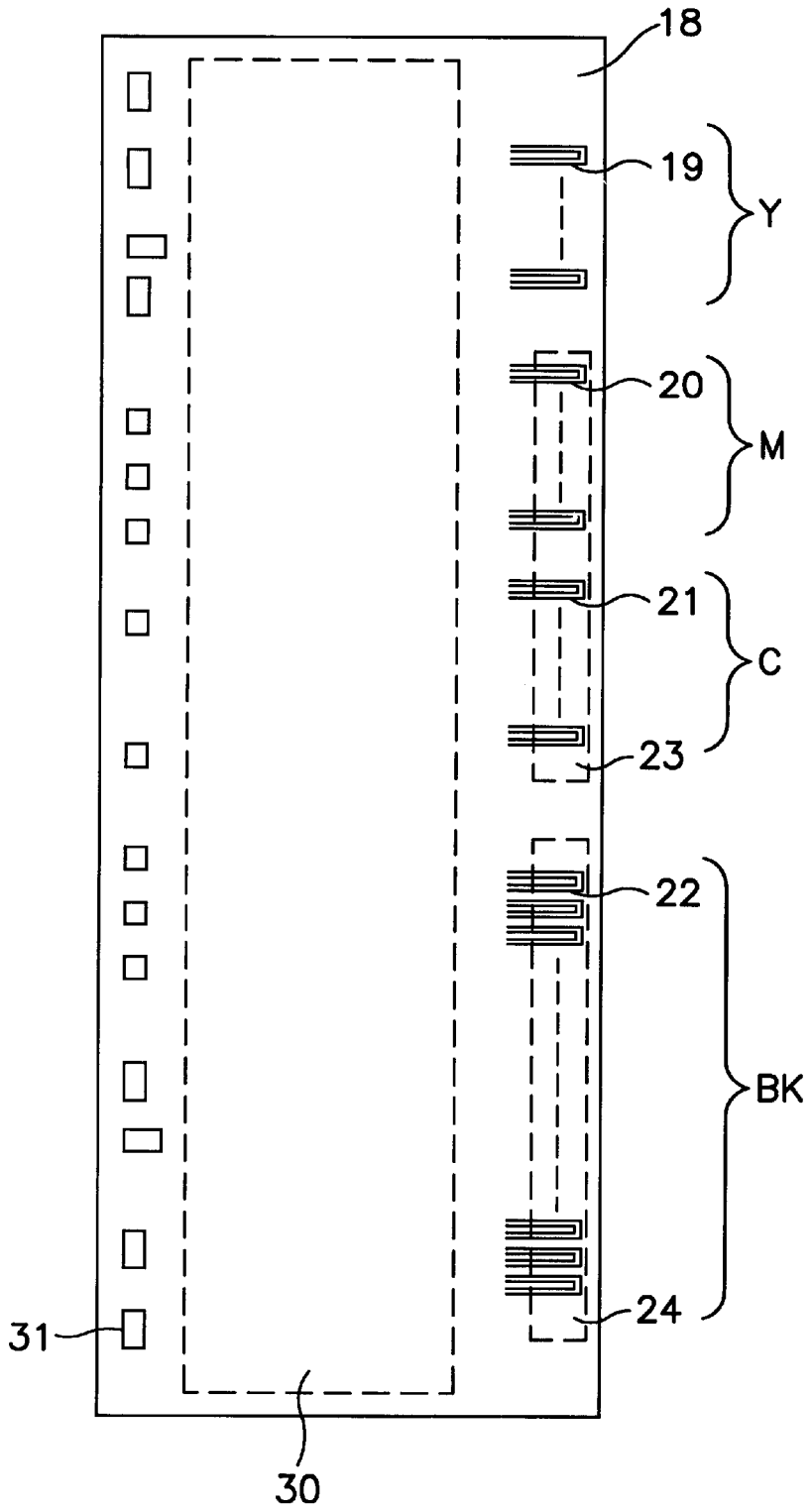
FIG. 4 is a schematic top plan view of the heater board, according to an embodiment of the present invention.

FIG. 4 is a top plan view of a heater board 18 according to another embodiment of the present invention. Designated by reference numerals 19, 20, 21 and 22 are heaters for the yellow, magenta, cyan and black inks. In the foregoing embodiment, the adjustment of the bubble creation threshold voltage and driving voltage, is effected by adjusting the length of the heater and the wiring. In this embodiment, the adjustment is made by changing the thickness of the passivation layer. More particularly, the black ink heater 22 has a width of 30 μm and a length of 150 μm and has a wiring resistance of 15 Ω. Each of the heaters 20 and 21 for the magenta and cyan inks, respectively, has a width of 24 μm and a length of 120 μm and has a wiring resistance of 10 Ω. The heater 19 for the yellow ink has a width of 21 μm and a length of 105 μm and has a wiring resistance of 10 Ω. When such a heater is driven by the same driving pulse, the amounts of heat generation are different for the different configuration heaters, for the reasons described hereinbefore. In this embodiment, the difference in the heat generation amounts are removed by controlling the thickness of the $SiO_2$ passivation layer on the heaters. The black ink heater 20 exhibiting relatively lower heat generation amount is coated with a thickness of protection layer (passivation layer) of 1 μm in thick; for the heaters 20 and 21 for the magenta and cyan inks, it is 1.6 μm; and for the heater 19 for the yellow ink exhibiting a relatively higher heat generation amount, it has 1.8 μm in thickness. For the formation of the $SiO_2$ passivation layers having different thicknesses, there are several methods. In this embodiment, $SiO_2$ of 1.8 μm thickness is sputtered on the entirety. Subsequently, the portion other than the black ink heaters 22, is protected with a photoresist, and then $SiO_2$ layer is etched by 0.6 μm in the thickness direction. Subsequently, the portion other than the black ink heaters 22 and the magenta and cyan ink heaters 20 and 21, are protected with photoresist, and then the $SiO_2$ layer is etched by 0.2 μm in the direction of the thickness.

In this manner, it has 1.0 μm on the black ink heater 22 (24 in the Figure); on the heaters 20 and 21 for the magenta and cyan inks, it has a thickness of 1.6 μm (23, in the Figure); on the heater 19 for the yellow ink, the $SiO_2$ passivation layer has a thickness of 1.8 μm. Thereafter, similarly to the first embodiment, a Ta layer having a common thickness is formed on each of the heater. In addition, nozzles are formed, so that a bubble jet printing head is provided. As a result, a printing head is provided with the black, magenta, cyan and yellow ink heaters 19–22 with the bubble creation threshold voltage of approx 24.3 V (common) with the applied voltage pulse width of 3 μsec. Thus, the proper applied voltage of the driving signal is commonly approx. 28 V with the pulse width of 3 μsec. It is a possible alternative that the thickness of Ta layer rather than the thickness of the $SiO_2$ passivation layer is changed. In this embodiment, the thickness of the passivation layer contactable with the ink on the heater is changed for the respective heaters having different configurations, by which the amount of the heat transferred to the ink is adjusted. On the basis of this, the driving signal is made common. However, passivation films exhibiting low thermal conductivities for the heater having the configuration providing the large amount of heat may be usable. In this embodiment, the passivation film layer constitutes a part of the electrothermal transducer, similarly to the heat generating element and the wiring.

In the foregoing first and second embodiment providing the common driving voltage, black magenta, cyan and yellow ink heaters are formed on the same substrate with different heater dimensions for the purpose of providing a small printing head. Thus, these embodiments are preferable if downsizing is particularly desirable. However, the present invention is not limited to the case in which the heaters are formed on a common substrate. More particularly, the present invention is applicable to an ink jet printing head using separate black, magenta, cyan and yellow ink heads (four heads), so that the voltage application condition to the heaters are common for the four heads. The present invention is not limited to the color ink jet recording apparatus usable with black, magenta, cyan and yellow ink materials. For a monochromatic ink jet recording apparatus using heaters providing an ejection volume of 80 pl for plain paper and heaters having an ejection volume of 45 pl for the paper particularly for ink jet printing (coated with silica or the like), the present invention is usable by using different size heaters so as to provide the common application voltage condition to the heater.

In the foregoing embodiments using different configuration heaters, the bubble creation threshold voltage (the minimum voltage creating a bubble through film boiling in the ink, that is, the minimum voltage ejecting the ink), is determined in the following manner. The printing head is connected with an external voltage source, and the heaters are driven with a voltage, and the heater is driven with an increased voltage, and this is repeated with the increasing voltage, and the threshold voltage is determined as the voltage with which the ink is first ejected.

In the foregoing embodiment, the bubble creating threshold voltage is made substantially constant for the heaters having different configurations. The voltage is not necessarily required to be exactly the same, but it is satisfactory if the voltage is within 4% range on the basis of the average of the threshold voltages, since then ink ejection is properly carried out.

For the better ink ejection, the range is further preferably not more than 2%.

Figure 5:
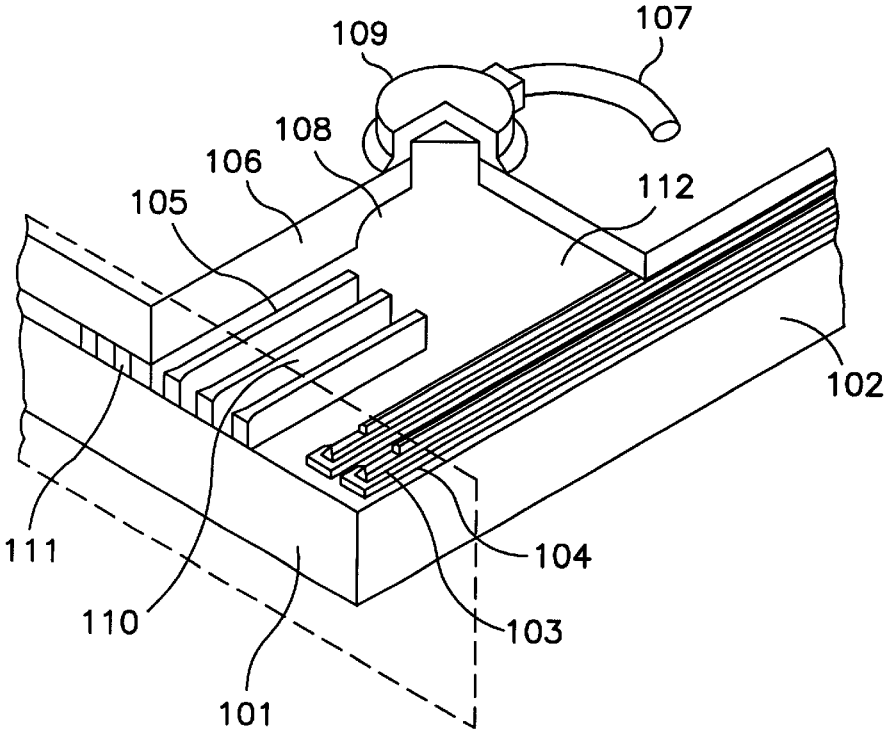
FIG. 5 is a schematic view of an ink jet printing head exemplifying the invention.

FIG. 5 is a partial perspective view of an exemplary ink jet printing head of the invention, wherein heat generating resistors 103, wiring 104, liquid passage walls 105 and a top plate 106 have been manufactured through semiconductor device manufacturing processes including etching, evaporation, sputtering or the like processes. The recording liquid 112 is supplied into a common liquid chamber 108 of the recording head 101 through a liquid supply pipe 107 from an unshown liquid container. Designated by a reference numeral 109 is a connector for the liquid supply. The liquid 112 supplied into the common liquid chamber 108 is then supplied into a liquid passage 110 by capillary force, and is stably retained by the meniscus formed in the ejection outlet (orifice) at the end of the liquid passage.

Upon supply of the electric energy to the heat generating resistor 103, the liquid on the heat generating resistor surface is rapidly heated so that a bubble is produced in the liquid passage. By the expansion and contraction of the bubble, the liquid is ejected through the ejection outlet 111, so that a droplet of the liquid is formed. With the above-described structure, 128 or 256 ejection outlets can be formed at a high density such as 16 nozzles per mm. In addition, a multi-nozzle ink jet printing head having ejection outlets in a range covering the entirety of the recording width can be formed.

Figure 6:
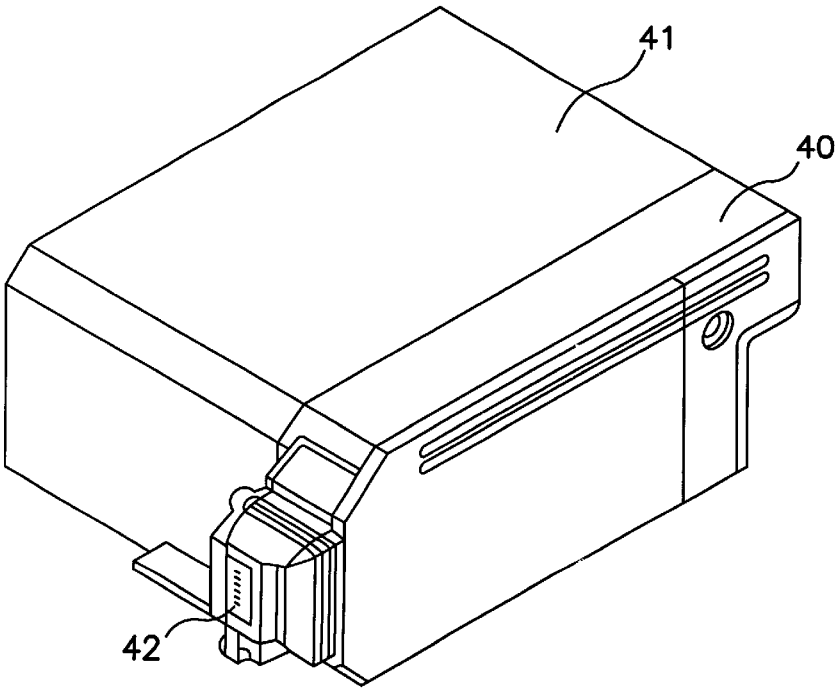
FIG. 6 is a schematic view of an ink jet head cartridge according to an embodiment of the invention.

FIG. 6 shows an ink jet cartridge having an ink jet printing head 40 according to an embodiment of the present invention.

The ink jet head cartridge is provided with an ink container 41 which is detachably mountable to the ink jet printing head 40 or which is inseparably connected thereto. The ink supplied from the ink container is ejected through the ejection outlet 42 to effect the printing operation.

The ink container may be in the form of a container for containing only one color ink matched with the printing head. Or, it may be an integral ink container capable of containing yellow, magenta and cyan ink container, for example.

Figure 7:
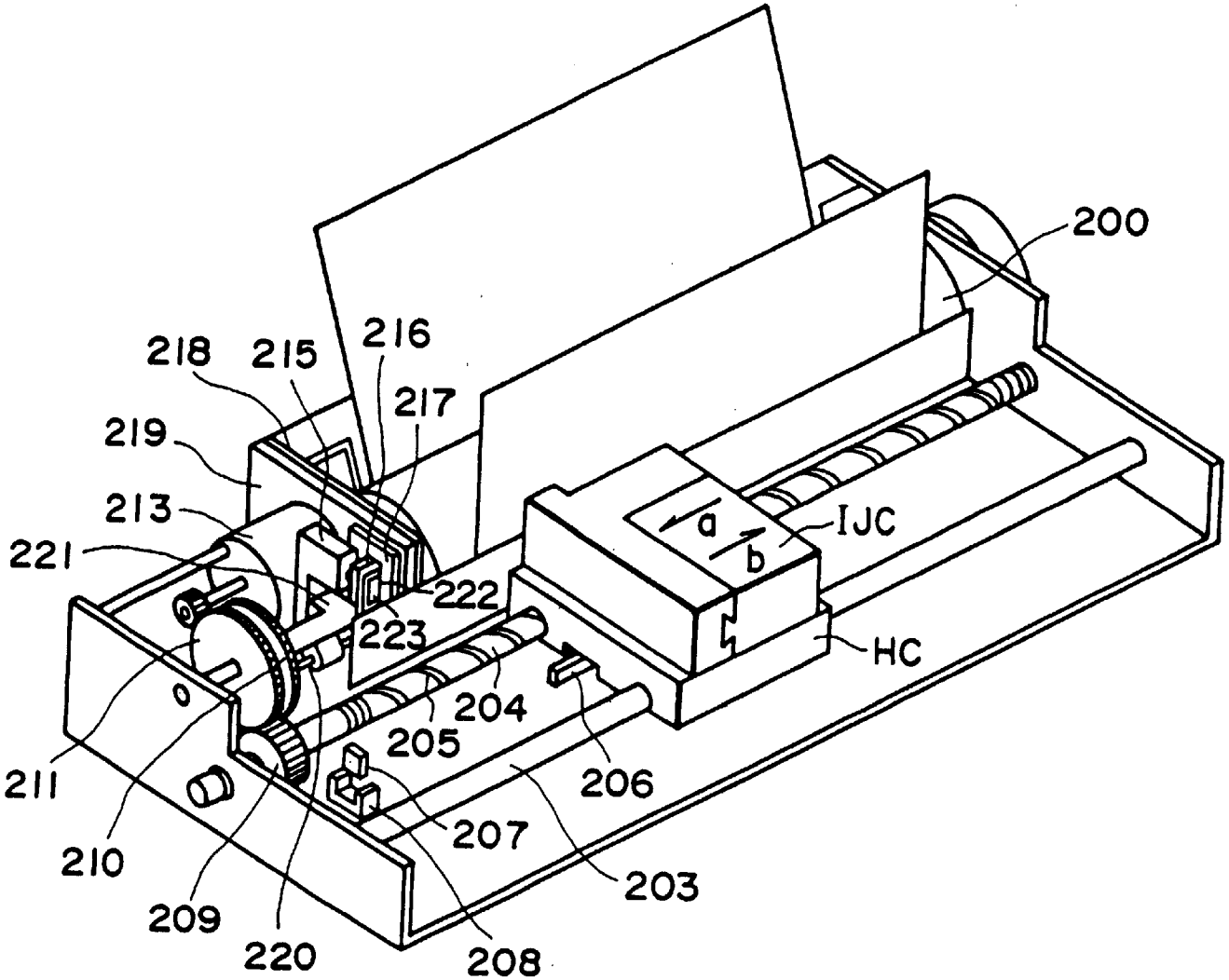
FIG. 7 is a schematic view of an ink jet printing apparatus according to an embodiment of the invention.
Figure 8:
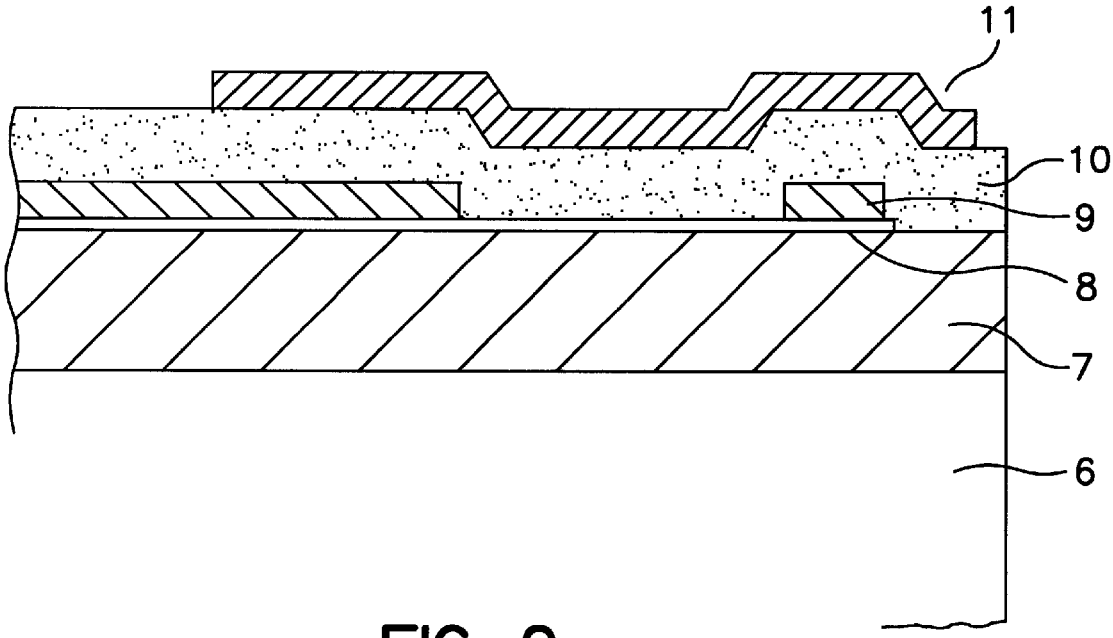
FIG. 8 is an enlarged schematic view of the heaters on a heater substrate or board, according to an embodiment of the present invention, similarly to FIG. 2, but the thickness of the protection layer differs from that shown in FIG. 2.

FIG. 7 shows an outer appearance of an example of an ink jet printing apparatus IJRA containing an ink jet printing head or an ink jet cartridge according to the present invention. A carriage HC is engaged with a helical groove 204 of a lead screw rotated through transmission gears 211 and 209 upon forward or backward rotation of the driving motor 213. The carriage HC is provided with an unshown pin to be reciprocated in directions indicated by arrows a and b. Designated by a reference numeral 202 is a sheet confining plate which is effective to confine the recording sheet to a platen 200 over a movable range of the carriage HC. In this apparatus, the ink is ejected from the recording head onto the recording sheet to effect the printing.

Elements 207 and 208 constitute a photocoupler to detect the existence of a lever 206 of the carriage HC to switch the rotational direction of the motor 213. Thus, the photocouplers function as home position detecting means. A capping member 222 for capping a front side of the recording head is supported by a supporting member 216. Sucking means 215 for sucking the inside of the cap 222 effects a sucking recovery operation of the recording head through an opening 223 of the cap. Designated by a reference numeral 217 is a cleaning blade, and it is moved to and fro by a member 218 which is supported on a main assembly supporting frame 218. The blade 217 may be in the form of a known cleaning blade. A lever 221 is effective to start the sucking recovery action. It is moved with the movement of a cam 220 engaged with the carriage HC, and the driving force from the driving motor 213 is controlled through a known transmitting means such as a clutch or the like.

The capping, cleaning and sucking recovery operations can be carried out when the carriage HC is located adjacent the home position, by the action of the lead screw 205. Any known method is usable if the timing control is properly carried out. The foregoing printing apparatus is a preferable example.

In the recording apparatus of this embodiment, there is provided recording signal supplying means for supplying to the recording head a signal for driving the recording head mounted thereon, and there is provided with a controller having control means controlling the driving of the recording apparatus.

The ink container mounted on this apparatus is illustrated as being integral with the recording head (ink jet head unit). However, the present invention is not limited to this, and is applicable to the case in which the ink container and the recording head are separate, and the ink is supplied to the recording head through an ink supply passage, or to the case in which the head portion and the ink container portion are detachably mountable. The printing may be effected on cloth or the like by the printing apparatus using the ink jet printing head according to the present invention.

In the foregoing description, "print" covers the case in which an image having no information is recorded, in addition to the case in which character, figure or the like are recorded.

As described, according to the present invention, there is provided an ink jet recording apparatus having heaters of different dimensions, and the heaters can be driven by the same electric driving signal, and therefore, only one kind of voltage application circuit for the electric pulse is enough in the main assembly, and therefore, the apparatus cost can be significantly reduced. The heater durability is also increased, so that the service life of the heater is extended.

While the invention has been described with reference to the structures disclosed herein, it is not confined to the details set forth and this application is intended to cover such modifications or changes as may come within the purposes of the improvements or the scope of the following claims.

What is claimed is:

1. A liquid jet printing head having a plurality of electrothermal transducers, each having a driving voltage, for creating a bubble in liquid upon electric energy supply thereto from an electric energy supply and ejecting the liquid by pressure produced by creation of the bubble, comprising:

a first electrothermal transducer having a first heat generating resistor with a first area and wiring electrically connected with said first heat generating resistor; and a second electrothermal transducer having a second heat generating resistor with an area which is different from the first area of said first heat generating resistor so that said first and second electrothermal transducers eject different amounts of liquid relative to each other for application of a given amount of electric energy, and wiring electrically connected with said second heat generating resistor;

wherein each of said first and second electrothermal transducers have a threshold voltage for generating a bubble in the liquid and those said threshold voltages are the same, and said first and second electrothermal transducers are supplied with the driving voltage from a same voltage source, wherein said first heat generating resistor has a first length and said second heat generating resistor has a second length, and wherein the first and second lengths of said respective first and second heat generating resistors, measured in the wiring direction, are substantially the same.

2. A liquid jet printing head according to claim 1, wherein driving voltages for said first and second electrothermal transducers are within a range not more than 4% from an average of bubble production threshold voltages of said first and second electrothermal transducers.

3. A liquid jet printing head according to claim 1, wherein a width of said wiring is larger for said first heat generating resistor than a width of wiring for said second heat generating resistor, said first heat generating area being larger than said second heat generating area.

4. A liquid jet printing head according to claim 3, wherein said first electrothermal transducer ejects a black ink material.

5. A liquid jet printing head according to claim 1, wherein said first and second electrothermal transducers are formed on a same substrate.

6. A liquid jet printing head according to claim 1, wherein the liquid is ink.

7. A liquid jet printing head according to claim 6, wherein the areas of said first and second heat generating resistors are different for different color inks.

8. A liquid jet printing head having a plurality of electrothermal transducers, each having a driving voltage, for creating a bubble in a liquid upon electric energy supply thereto from an electric energy supply and ejecting the liquid by pressure produced by creation of the bubble, comprising:

a first electrothermal transducer having a first heat generating resistor with a first area and wiring electrically connected with said first heat generating resistor;

a second electrothermal transducer having a second heat generating resistor with an area which is different from the first area of said first heat generating resistor so that said first and second electrothermal transducers eject different amounts of liquid relative to each other for application of a given amount of electric energy, and wiring electrically connected with said second heat generating resistor;

a first passivation layer covering said first heat generating resistor, said first passivation layer having a thickness; and a second passivation layer covering said second heat generating resistor, said second passivation layer having a thickness;

wherein each of said first and second electrothermal transducers have a threshold voltage for generating a bubble in the liquid and those said threshold voltages are the same, and said first and second electrothermal transducers are supplied with the driving voltage from a same voltage source, and wherein the thicknesses of said first and second passivation layers are different.

9. A liquid jet printing head according to claim 8, wherein said first heat generating resistor, which has a larger area than said second heat generating resistor, has a thicker passivation layer than said second electrothermal transducer.

10. A liquid jet printing head according to claim 9, wherein said first electrothermal transducer ejects a black material.

11. A liquid printing head according to claim 8, wherein the liquid is ink.

12. A liquid jet printing head according to claim 11, wherein the areas of said first and second heat generating resistors are different for different color inks.

13. A liquid jet head cartridge comprising:

(a) a liquid jet printing head having a plurality of electrothermal transducers for creating a bubble in a liquid upon electric energy supply thereto from an electric energy supply and ejecting the liquid by pressure produced by creation of the bubble, said liquid jet printing head including:

a first electrothermal transducer having a first heat generating resistor with a first area and wiring electrically connected with said first heat generating resistor, and a second electrothermal transducer having a second heat generating resistor with an area which is different from the first area of said first heat generating resistor so that said first and second electrothermal transducers eject different amounts of liquid relative to each other for application of a given amount of electric energy, and wiring electrically connected with said second heat generating resistor, wherein each of said first and second electrothermal transducers have a threshold voltage for generating a bubble in the liquid and those said threshold voltages are the same, and said first and second electrothermal transducers are supplied with the driving voltage from a same voltage source; and (b) a liquid container for containing ink to be supplied to said liquid jet printing head via a supply means for supply the ink, wherein said first heat generating resistor has a first length and said second heat generating resistor has a second length, and wherein the first and second lengths of said respective first and second heat generating resistors, measured in the wiring direction, are substantially the same.

14. A liquid jet head cartridge comprising:

(a) a liquid jet printing head having a plurality of electrothermal transducers for creating a bubble in a liquid upon electric energy supply thereto from an electric energy supply and ejecting the liquid by pressure produced by creation of the bubble, said liquid jet printing head including:

a first electrothermal transducer having a first heat generating resistor with a first area and wiring electrically connected with said first heat generating resistor, and a second electrothermal transducer having a second heat generating resistor with an area which is different from the first area of said first heat generating resistor so that said first and second electrothermal transducers eject different amounts of liquid relative to each other for application of a given amount of electric energy, and wiring electrically connected with said second heat generating resistor, wherein each of said first and second electrothermal transducers have a threshold voltage for generating a bubble in the liquid and those said threshold voltages are the same, and said first and second electrothermal transducers are supplied with the driving voltage from a same voltage source;

(b) a liquid container for containing ink to be supplied to said liquid jet printing head via a supply means for supplying the ink;

(c) a first passivation layer covering said first heat generating resistor, said first passivation layer having a thickness; and (d) a second passivation layer covering said second heat generating resistor, said second passivation layer having a thickness, wherein the thicknesses of said first and second passivation layers are different.

15. A liquid jet printing apparatus, comprising:

(a) a liquid jet printing head having a plurality of electrothermal transducers for creating a bubble in a liquid upon electric energy supply thereto, from an electric energy supply and ejecting the liquid by pressure produced by creation of the bubble, said liquid jet printing head including:

a first electrothermal transducer having a first heat generating resistor with a first area and wiring electrically connected with said first heat generating resistor, and a second electrothermal transducer having a second heat generating resistor with an area which is different from the first area of said first heat generating resistor so that said first and second electrothermal transducer eject different amounts of liquid relative to each other for application of a given amount of electric energy, and wiring electrically connected with said second heat generating resistor, wherein each of said first and second electrothermal transducers have a threshold voltage for generating a bubble in the liquid and those said threshold voltages are the same, and said first and second electrothermal transducers are supplied with the driving voltage from a same voltage source; and (b) electrical signal supplying means for supplying an electric signal to said liquid jet printing head, wherein said first heat generating resistor has a first length and said second heat generating resistor has a second length, and wherein the first and second lengths of said respective first and second heat generating resistors, measured in the wiring direction, are substantially the same.

16. A liquid jet printing apparatus comprising:

(a) a liquid jet printing head having a plurality of electrothermal transducers for creating a bubble in a liquid upon electric energy supply thereto, from an electric energy supply and ejecting the liquid by pressure produced by creation of the bubble, said liquid jet printing head including:

a first electrothermal transducer having a first heat generating resistor with a first area and wiring electrically connected with said first heat generating resistor, and a second electrothermal transducer having a second heat generating resistor with an area which is different from the first area of said first heat generating resistor so that said first and second electrothermal transducers eject different amounts of liquid relative to each other for application of a given amount of electric energy, and wiring electrically connected with said second heat generating resistor, wherein each of said first and second electrothermal transducers have a threshold voltage for generating a bubble in the liquid and those said threshold voltages are the same, and said first and second electrothermal transducers are supplied with the driving voltage from a same voltage source; and (b) electrical signal supplying means for supplying an electric signal to said liquid jet printing head;

(c) a first passivation layer covering said first heat generating resistor, said first passivation layer having a thickness; and (d) a second passivation layer covering said second heat generating resistor, said second passivation layer having a thickness, wherein the thicknesses of said first and second passivation layers are different.

* * * * *

UNITED STATES PATENT AND TRADEMARK OFFICE

CERTIFICATE OF CORRECTION

PATENT NO. : 6,412,920 B1
DATED : July 2, 2002
INVENTOR(S) : Haruyuki Matsumoto et al.

It is certified that error appears in the above-identified patent and that said Letters Patent is hereby corrected as shown below:

Column 1,
Line 62, “energy using-” should read -- energy-using --; and
Line 65, “50 pl” should read -- 50 pl, 50 pl --.

Column 2,
Line 46, “ink,” should read -- ink --.

Column 4,
Line 15, “wiring,” should read -- wiring are shown --;
Line 32, “an” (second occurrence) should read -- a -- “” should read ----; and
Line 62, “heat” should read -- head --.

Column 5,
Line 31, “thick;” should read -- thickness; --; and
Line 50, “heater.” should read -- heaters. --.

Column 6,
Line 4, “embodiment” should read -- embodiments --; and
Line 5, “black” should read -- black, --.

Column 7,
Line 51, “with” should be deleted.

Column 8,
Line 17, “liquid” should read -- a liquid --.

UNITED STATES PATENT AND TRADEMARK OFFICE

CERTIFICATE OF CORRECTION

PATENT NO. : 6,412,920 B1
DATED : July 2, 2002
INVENTOR(S) : Haruyuki Matsumoto et al.

It is certified that error appears in the above-identified patent and that said Letters Patent is hereby corrected as shown below:

Column 9,
Line 67, "supply" should read -- supplying --.

Signed and Sealed this

Fifteenth Day of April, 2003

JAMES E. ROGAN
*Director of the United States Patent and Trademark Office*